US011952228B2

(12) United States Patent
Strain et al.

(10) Patent No.: US 11,952,228 B2
(45) Date of Patent: Apr. 9, 2024

(54) NON-UNIFORM TAIL SEALING AND METHODS THEREOF

(71) Applicant: The Procter & Gamble Company, Cincinnati, OH (US)

(72) Inventors: Victoria Grace Strain, Symmes Township, OH (US); Gustav Andre Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 206 days.

(21) Appl. No.: 17/488,739

(22) Filed: Sep. 29, 2021

(65) Prior Publication Data

US 2022/0017320 A1 Jan. 20, 2022

Related U.S. Application Data

(63) Continuation of application No. 14/620,250, filed on Feb. 12, 2015, now Pat. No. 11,155,430.

(51) Int. Cl.
*B65H 19/29* (2006.01)
*B65H 35/02* (2006.01)

(52) U.S. Cl.
CPC ..... *B65H 19/29* (2013.01); *B65H 35/02* (2013.01); *B65H 2301/41442* (2013.01); *B65H 2301/414421* (2013.01); *B65H 2301/41443* (2013.01); *B65H 2301/414433* (2013.01); *B65H 2301/41484* (2013.01); *B65H 2511/135* (2013.01); *B65H 2511/20* (2013.01); *B65H 2519/00* (2013.01); *B65H 2701/124* (2013.01); *B65H 2701/1924* (2013.01)

(58) Field of Classification Search
CPC ..... B65H 2301/41422; B65H 19/29; B65H 2301/41484; B65H 2301/414433; B65H 2301/414436
See application file for complete search history.

(56) References Cited

U.S. PATENT DOCUMENTS

| | | | |
|---|---|---|---|
| 2,612,992 A | 10/1952 | Tinkham | |
| 3,505,270 A | 4/1970 | Laden | |
| 3,532,572 A | 10/1970 | Herman | |
| 3,532,573 A | 10/1970 | Herman | |
| 3,554,829 A | 1/1971 | Lackett, Sr. | |
| 3,567,552 A | 3/1971 | Heuff et al. | |

(Continued)

FOREIGN PATENT DOCUMENTS

| | | | | |
|---|---|---|---|---|
| EP | 1813178 A2 | | 8/2007 | |
| JP | 2006131400 | * | 5/2006 | ..... A47K 10/16 |

(Continued)

OTHER PUBLICATIONS

13707-MN PCT Search Report and Written Opinion for PCT/US2016/017728 dated Jun. 3, 2016, 13 pages.

(Continued)

*Primary Examiner* — George R Koch
*Assistant Examiner* — Christopher C Caillouet
(74) *Attorney, Agent, or Firm* — Richard L. Alexander

(57) ABSTRACT

A method for bonding the tail of a convolutely wound log to the body is provided. The method comprises the use of a bonding material to bond the tail to the wound log. The bonding material may be applied to application sites arranged in a non-uniform pattern.

20 Claims, 13 Drawing Sheets

(56) References Cited

U.S. PATENT DOCUMENTS

| | | | |
|---|---|---|---|
| 3,629,027 | A | 12/1971 | Germain |
| 3,696,777 | A | 10/1972 | Preen |
| 3,753,944 | A | 8/1973 | Sirota et al. |
| 3,787,264 | A | 1/1974 | Underwood |
| 3,935,057 | A | 1/1976 | Gray |
| 3,951,890 | A | 4/1976 | Reilly et al. |
| 3,960,272 | A | 6/1976 | Hartbauer et al. |
| 4,026,752 | A | 5/1977 | Hartbauer et al. |
| 5,143,776 | A | 9/1992 | Givens |
| 5,573,615 | A | 11/1996 | Vigneau et al. |
| 6,007,610 | A | 12/1999 | Matzinger et al. |
| 6,143,111 | A | 11/2000 | Biagiotti |
| 6,342,297 | B1 | 1/2002 | Labrash |
| 6,372,064 | B1 | 4/2002 | Butterworth et al. |
| 7,905,194 | B2 | 3/2011 | Byrne et al. |
| 8,002,927 | B2 | 8/2011 | Byrne |
| 8,263,689 | B2 | 9/2012 | Patel et al. |
| 9,382,086 | B2 | 7/2016 | Mellin et al. |
| 2004/0086698 | A1 | 5/2004 | Collins et al. |
| 2006/0155253 | A1 | 7/2006 | Dziezok et al. |
| 2007/0023492 | A1 | 2/2007 | Stude |
| 2007/0264461 | A1 | 11/2007 | Gelli |
| 2009/0029101 | A1 | 1/2009 | Rasch et al. |
| 2010/0028548 | A1 | 2/2010 | Biagioni et al. |
| 2014/0087116 | A1 | 3/2014 | Glatt |
| 2014/0131498 | A1 | 5/2014 | Brokopp, Jr. et al. |
| 2016/0236886 | A1 | 8/2016 | Strain et al. |

FOREIGN PATENT DOCUMENTS

| | | | |
|---|---|---|---|
| JP | 2009050433 | A | 3/2009 |
| JP | 2010082137 | A | 4/2010 |
| JP | 4668369 | B2 | 1/2011 |
| WO | 2007031884 | A1 | 3/2007 |

OTHER PUBLICATIONS

All Office Actions; U.S. Appl. No. 14/319,510, filed Jun. 30, 2014.
All Office Actions; U.S. Appl. No. 14/620,250, filed Feb. 12, 2015.
H. M. Ribeiro, "Structure and Rheology of Semisolid O/W Creams Containing CetylAlcohol/Non-Ionic Surfactant Mixed Emulsifier and Different Polymers", International Journal of Cosmetic Science, vol. 26, 2004, pp. 47-59.
Mark Kirwan, "Paper and Paperboard Packaging Technology", Williston, VT, Wiley-Blackwell, 2005, p. 85.
TAPPI Hot Melt Symposium, Durango, CO, Jun. 13-16, 1999, "New Water Dispersible HotMelts for Paper Bonding Applications", pp. 185-191.

* cited by examiner

NON-UNIFORM TAIL SEALING AND METHODS THEREOF

CROSS REFERENCE TO RELATED APPLICATION

This application is a continuation of, and claims priority under 35 U.S.C. § 120 to, U.S. patent application Ser. No. 14/620,250, filed on Feb. 12, 2015 the entire disclosure of which is hereby incorporated by reference.

TECHNICAL FIELD

The present disclosure provides for attaching the tail to the body of a convolutely wound log of web material.

BACKGROUND

In the manufacture of rolled web products, such as bath tissue or paper towels, a winder winds a web of material to form a large parent roll. The parent roll is then subsequently unwound, subjected to a variety of conversions, such as embossing, and then rewound by a rewinder into a consumer diameter sized convolutely wound log. The convolutely wound log is eventually cut into consumer width sized rolls, such as bath tissue, paper towels and similar finished products. To efficiently process the convolutely wound log through converting processes, cutting and packaging, the loose end of the log (i.e., the tail) is often secured or sealed to the body (i.e., the non-tail portion) during a tail sealing process.

Common gluing, moistening and other systems known to those in the tail sealing art typically require some manipulation of the tail for correct alignment for adhesive application, proper winding or rewinding and the like. In most commercially available embodiments, the tail is laid flat and unwrinkled against the log with the tail being secured to the log at a position a short distance from the very end of the tail using an adhesive-based material. This tail sealing arrangement leaves a small length of the end of the tail unsecured (the so-called "tab") to enable the end user to grasp, unseal and unwind the convolutely wound product.

The teal sealing process is typically used to aid in the downstream converting processes, such as to keep the roll from undesirably becoming unwound before it has been property packaged. As a consequence, however, the consumer is tasked with breaking the bond in order to use the rolled web product. Many known systems have been found deficient when attempting to obtain an amount of adhesion or type of adhesive that is sufficient for downstream manufacturing processes, yet not bonding the tail to the log in a fashion that is deemed inconvenient or frustrating from a consumer perspective. If the bond strength is too low or the amount of adhesive used is not sufficient, processing difficulty may be experienced. If the bond strength is too high, too much adhesive is utilized, or the seal is inconveniently placed relevant to the tab, a consumer interacting with the wound roll may experience difficulty when attempting to separate the tail from the wound roll from the body. For example, if the strength of the bond is stronger than the web substrate, the web material may undesirably tear when a consumer attempts to separate the tail from the body. In such instances, the torn portions of the roll may be considered unusable and wasted, resulting in consumer dissatisfaction or frustration.

Moreover, known tail sealing systems often utilize adhesives that dry relatively slowly. It is desirable, however, that tail seal adhesive dry quickly so that the bond is properly set in advance of downstream converting operations (e.g., wrapping, bundling, and other manipulation). A log typically is processed through such processes in about 5-10 minutes. Yet, known systems utilize adhesives with drying times of more than an hour, which fully dry long after the product is cycled through the manufacturing processes. In some cases, the bond strength even continues to increase even after the wound roll has been discharged from the manufacturing process and has been packaged.

Additionally, using conventional adhesive-based tail sealing techniques, once the adhesive is applied to the wound roll and the bond is formed through evaporation, the bond strength of the adhesive cannot be reduced. Therefore, although the tail does not necessarily need to be adhered to the body with relatively high bond strength subsequent to the manufacturing process, conventional bonding techniques do not allow for selective reversibility of the bond strength.

Thus, it would be advantageous to provide for a tail sealing system that addresses one or more of these issues. Indeed, it would be advantageous to provide for a tail sealing method that provides sufficient bonding for downstream converting operations while reducing negative end user feedback during interactions with the roll. It would be also advantageous to provide a tail seal having a bond strength that can be selectively increased and/or decreased. Specifically, it would be desirable to provide a tail seal with a bond strength that can be increased for manufacturing processes and then subsequently decreased in order to allow a consumer to more easily separate the tail from the body of the wound roll.

BRIEF DESCRIPTION OF THE DRAWINGS

The above-mentioned and other features and advantages of the present disclosure, and the manner of attaining them, will become more apparent and the disclosure itself will be better understood by reference to the following description of nonlimiting embodiments of the disclosure taken in conjunction with the accompanying drawings, wherein.

DETAILED DESCRIPTION

Figure 1:
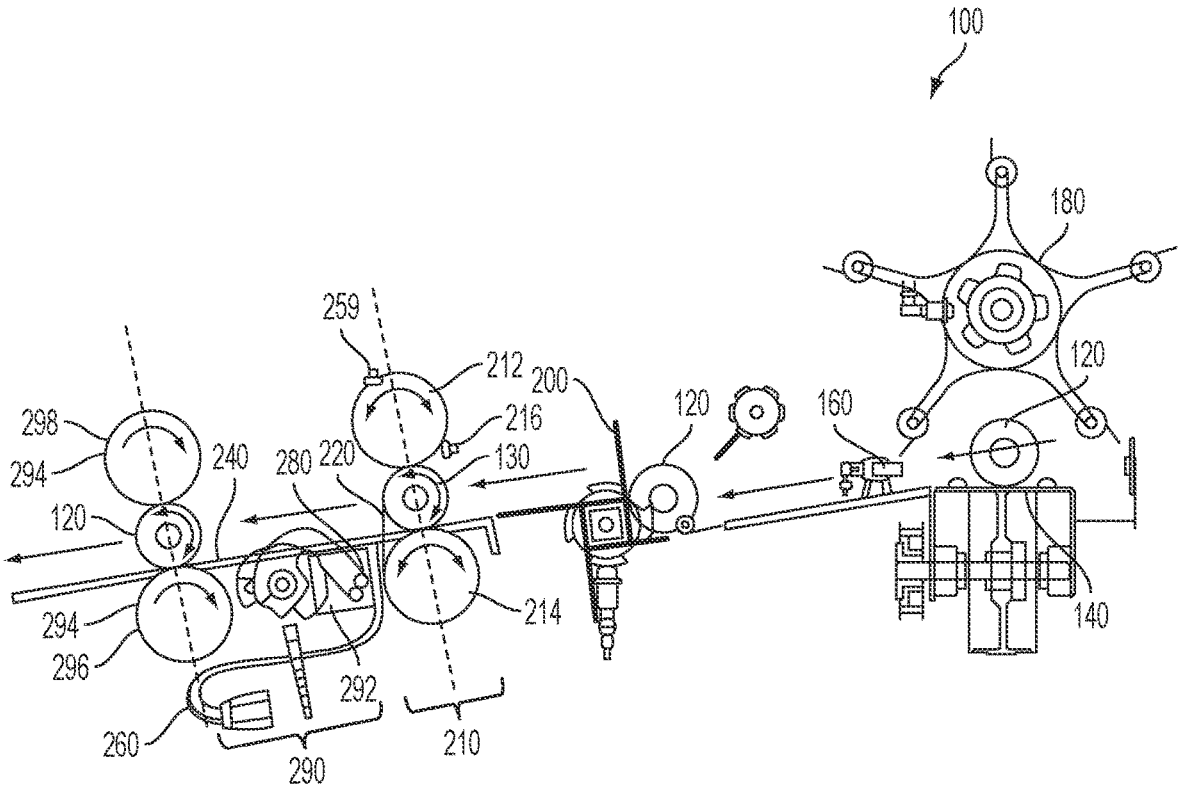
FIG. 1 is an exemplary typical tail sealing system.

The present disclosure provides for methods of tail sealing a convolutely wound log of material using a bonding material applied in a non-uniform pattern. Various nonlimiting embodiments of the present disclosure will now be described to provide an overall understanding of the principles of the function, design and use of the tail sealing methods as well as the tail sealed convolutely wound products disclosed herein. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment can be combined with the features of other nonlimiting embodiments. Such modifications and variations are intended to be included within the scope of the present disclosure.

Definitions

"Fibrous structure" as used herein means a structure that comprises one or more filaments and/or fibers. Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking and may subsequently be converted into a finished product (e.g., a sanitary tissue product such as a paper towel product). The fibrous structures of the present invention may be homogeneous or may be layered. If layered, the fibrous structures may comprise at least two and/or at least three and/or at least four and/or at least five layers. The fibrous structures of the present disclosure may be co-formed fibrous structures.

"Fiber" and/or "Filament" as used herein means an elongate particulate having an apparent length greatly exceeding its apparent width (i.e., a length to diameter ratio of at least about 10). In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Nonlimiting examples of fibers include wood pulp fibers and synthetic staple fibers such as polyester fibers.

Filaments are typically considered continuous or substantially continuous in nature. Filaments are relatively longer than fibers. Nonlimiting examples of filaments include meltblown and/or spunbond filaments. Nonlimiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present disclosure, "fiber" refers to papermaking fibers. Papermaking fibers useful in the present disclosure include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present disclosure are fibers derived from recycled paper, which may contain any or all of the above categories as well as other non-fibrous materials such as fillers and adhesives used to facilitate the original papermaking.

"Sanitary tissue product" as used herein means a soft, low density (i.e., <about 0.15 g/cm$^3$) web useful as a wiping implement for post-urinary and post-bowel movement cleaning (toilet tissue), for otorhinolaryngological discharges (facial tissue) and multi-functional absorbent and cleaning uses (absorbent towels). The sanitary tissue product may be convolutely wound upon itself about a core or without a core to form a sanitary tissue product roll.

The sanitary tissue products and/or fibrous structures of the present disclosure may exhibit a basis weight of greater than 15 g/m$^2$ (9.2 lbs/3000 ft$^2$) to about 120 g/m$^2$ (73.8 lbs/3000 ft$^2$) and/or from about 15 g/m$^2$ (9.2 lbs/3000 ft$^2$) to about 110 g/m$^2$ (67.7 lbs/3000 ft$^2$) and/or from about 20 g/m$^2$ (12.3 lbs/3000 ft$^2$) to about 100 g/m$^2$ (61.5 lbs/3000 ft$^2$) and/or from about 30 (18.5 lbs/3000 ft$^2$) to 90 g/m$^2$ (55.4 lbs/3000 ft$^2$). In addition, the sanitary tissue products and/or fibrous structures of the present disclosure may exhibit a basis weight between about 40 g/m$^2$ (24.6 lbs/3000 ft$^2$) to about 120 g/m$^2$ (73.8 lbs/3000 ft$^2$) and/or from about 50 g/m$^2$ (30.8 lbs/3000 ft$^2$) to about 110 g/m$^2$ (67.7 lbs/3000 ft$^2$) and/or from about 55 g/m$^2$ (33.8 lbs/3000 ft$^2$) to about 105 g/m$^2$ (64.6 lbs/3000 ft$^2$) and/or from about 60 (36.9 lbs/3000 ft$^2$) to 100 g/m$^2$ (61.5 lbs/3000 ft$^2$).

The sanitary tissue products of the present disclosure may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present disclosure may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in).

In another example, the sanitary tissue products of the present disclosure may exhibit a total dry tensile strength of greater than about 196 g/cm (500 g/in) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present disclosure may exhibit an initial total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present disclosure may exhibit an initial total wet tensile strength of greater than about 118 g/cm (300 g/in) and/or greater than about 157 g/cm (400 g/in) and/or greater than about 196 g/cm (500 Win) and/or greater than about 236 g/cm (600 g/in) and/or greater than about 276 g/cm (700 g/in) and/or greater than about 315 g/cm (800 g/in) and/or greater than about 354 g/cm (900 g/in) and/or greater than about 394 g/cm (1000 g/in) and/or from about 118 g/cm (300 g/in) to about 1968 g/cm (5000 g/in) and/or from about 157 g/cm (400 g/in) to about 1181 g/cm (3000 g/in) and/or from about 196 g/cm (500 g/in) to about 984 g/cm (2500 g/in) and/or from about 196 g/cm (500 g/in) to about 787 g/cm (2000 g/in) and/or from about 196 g/cm (500 g/in) to about 591 g/cm (1500 g/in).

The sanitary tissue products of the present disclosure may exhibit a density (measured at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present disclosure may comprise additives such as softening agents, such as quaternary ammonium softening agents, temporary wet strength agents, permanent wet strength agents, bulk softening agents, lotions, silicones, wetting agents, latexes, dry strength agents, and other types of additives suitable for inclusion in and/or on sanitary tissue products.

The embodiments discussed herein may be utilized with a convolutely wound log of web material, such as a convolutely wound log of a fibrous structure. The fibrous structure may comprise a sanitary tissue product.

"Consumer-sized product unit" as used in herein means the width of a finished product of convolutely wound web material, as measured in the cross machine direction, as such product will be packaged, sold, distributed or otherwise provided to end users.

"Phase-change material" (PCM) as used herein means a substance that changes from a solid phase to an amorphous phase, and vice versa, as heat is absorbed or released. When the PCM is heated to above its transition temperature, the PCM generally behaves as a low viscosity Newtonian fluid. The transition temperature is the temperature at which a phase change from amorphous to non-amorphous occurs or where a remarkable change in viscosity from high viscosity to low viscosity occurs.

"Nonadhesive PCM" as used herein means a PCM is void or substantially void of glue or other types of adhesives. When used to bond web substrates, the nonadhesive PCM utilizes mechanical entanglement of fibers of each of the web substrates to form the bond. Further, unlike adhesive materials, a nonadhesive PCM does not rely on evaporation to transition from an amorphous phase to a non-amorphous phase.

"Bonding material" as used herein means any substance that may be used to join two or more web substrates. Bonding materials can include adhesive based materials, such as glues, or nonadhesive-based materials, such as nonadhesive PCMs.

"Application site" as used herein means the desired location at which a bonding material is to be deposited on a web material. The application site may be located, for example, on the tail, the body (i.e., the non-tail portion of the log) or, the crevice where the tail and the body meet. "Machine direction" or "MD" as used herein means the direction parallel to the flow of the web material through the manufacturing equipment.

"Cross machine direction" or "CD" as used herein means the direction parallel to the width of the manufacturing equipment and perpendicular to the machine direction.

The Z-direction is orthogonal both the machine direction and cross machine direction, such that the machine direction, cross machine direction and Z-direction form a Cartesian coordinate system.

"Non-uniform pattern" as used herein means lacking an evenly spaced distribution pattern and instead being a pattern that is asymmetric about one or more of an axis parallel to the MD and an axis parallel to CD. "Above", "over", "top", "up", "below", "beneath", "bottom" and "under" and similar orientational words and phrases, except upstream and downstream, as used herein to describe embodiments are to be construed relative to the normal orientation, where the floor is located in the Z-direction below, beneath or under a tail sealing apparatus and the ceiling is located in the Z-direction above or over a tail sealing apparatus. Articles expressed as being above, over, on top and the like are located (or moving) in the Z-direction closer to the ceiling than the items to which they are being compared. Similarly, articles expressed as being below, beneath or under and the like are located (or moving) in the Z-direction closer to the floor than their respective comparators. One of skill in the art will recognize that the relationship between the article and its respective comparator is more significant than the relationship between the article and the floor or the ceiling. As such, inverted arrangements of articles as disclosed herein are included within the scope of this disclosure. Said differently, to the extent such configurations are workable, this disclosure is intended to include an apparatus and/or method where everything expressed as "below" is inverted to be "above" and everything expressed as "above" is inverted to be "below" and similar reversals or inversions.

"Downstream" as used herein means a step or system occurring or present later in a processing continuum. "Upstream" as used herein means a step or system occurring or present earlier in a processing continuum.

Referring now to FIG. 1, an exemplary tail sealer system 100 is depicted in accordance with one nonlimiting embodiment of the present disclosure. The tail sealer system 100 may be positioned directly downstream of a rewinder (not shown) and may be an integral part of a converting operation. Generally, the tail sealer system 100 may be provided with a: 1. Log in-feed; 2. Log index to sealing station; 3. Tail detection and positioning; 4. bonding material application; 5. Tail rewinding; and 6. Log discharge. While tail sealer systems may utilize any of a variety of bonding material application techniques, the tail sealer system in FIG. 1 is shown having a "blade-in-pan" or "plate" style tail sealer. Other example tail sealer systems may apply the bonding material using, for example, one or more spray nozzles, print applicators, rotary sealers, extrusions ports, or combinations thereof, or any number of other suitable application techniques.

As shown in FIG. 1, the wound log 120 enters at the in-feed conveyor 140. An incoming log detector 160 (e.g., a photo eye sensor) detects when the wound log 120 is in position on the in-feed conveyor 140 and activates a rotary kicker 180 that pushes the wound log 120 off the conveyor 140 toward the index paddle 200. The index paddle 200 receives the wound log 120 and holds it until the in-feed rolls 210 are clear. The index paddle 200 then indexes about 90 degrees, moving the wound log 120 into the in-feed rolls 210. In-feed rolls 210 will typically comprise an upper in-feed roll 212 and a lower in-feed roll 214 (typically a vacuum roll).

The in-feed rolls 210 initially rotate in the same direction but at mismatched speeds, with the upper in-feed roll 212 rotating faster than the lower in-feed (or vacuum) roll 214. The distance of upper in-feed roll 212 relative to lower in-feed roll 214 can be adjusted to accommodate the wound log 120 diameter. However, the upper in-feed roll 212 is typically positioned to create some interference with the wound log 120. When the wound log 120 is fed into the in-feed rolls 210, the wound log 120 may be controlled at the top and bottom log 120 positions because of the interference and rate of log 120 travel is controlled by the speed difference between the in-feed rolls 210. If there is too little or no interference, the wound log 120 could slide through the in-feed rolls 210. Conversely, if there is too much interference, the logs 120 may not feed into the in-feed rolls 210 correctly and could cause a jam up at the index paddle 200.

As the wound log 120 contacts the in-feed rolls 210, it is pulled into the nip between the in-feed rolls 210 by the differential speed. As the wound log 120 reaches the diagonal center of the in-feed rolls 210, it blocks the log in-feed rollers detector 216 (e.g., photo eye sensor) at which time the in-feed rolls 210 rotate at a matched speed. This holds the wound log 120 in position while an airblast nozzle 259 emits a stream of air to separate the tail 220 from the wound log 120 and positions the tail 220 flat onto the table 240 where a tail detector 260 (e.g., a photoelectric cell) becomes blocked by the tail 220. As the wound log 120 rotates and rewinds the separated tail 220, the tail detector 260 becomes unblocked when the edge of the tail 220 has been located.

After the edge of the tail 220 is detected, the tail 220 is rewound onto the wound log 120 until the edge of the tail 220 is directly underneath the body 130 of the wound log 120. The in-feed rolls 210 stop and reverse direction, which unrolls the tail 220 from the body 130. The tail 220 is held by vacuum to the lower in-feed roll 214 and follows the lower in-feed roll 214 as it is unwound until a calculated length of tail 220 has been separated from the body 130. The in-feed rolls 210 then stop and the upper in-feed roll 212 starts rotating back in the forward direction to eject the body 120 from the in-feed rolls 210. The tail length centerline controls the amount of tail 220 that is unwound from the wound log 120 and is typically adjusted to get the target tab length. The speed of in-feed rolls 210 can impact consistent tail detection. Higher speeds can reduce the time to rotate the wound log 120 but may not increase rate capability. The speed of in-feed rolls 210 can be adjusted to consistently detect the tail 220 on the first revolution.

Pan 292 may contain any suitable bonding material. In some embodiments, the bonding material contained by the pan 292 is a nonadhesive PCM in an amorphous state. Additional details regarding example nonadhesive PCMs are provided below. In such embodiments, in order to maintain a desired viscosity of the nonadhesive PCM the pan 292 may be heated. While the tail 220 is being detected, the blade (or bar or wire) 280 of the blade-in-pan assembly (or bar or wire and pan assembly) 290 is submerged in the pan 292. A plurality of blades 280 may be used to achieve the desired non-uniform tail sealing pattern. In any event, after the tail of log 220 is detected, the blade 280 is raised out of the pan 292 carrying an amount of the bonding material and is timed so that the body 130 rolls over blade 280 after being ejected from the in-feed rolls 210. After the wound log 120 passes, the blade 280 is lowered back into the pan 292. The blade 280 height can be adjusted so that the top of the blade 280 is slightly higher than the adjacent table 240. As described in more detail below, the bonding material can be applied in a non-uniform pattern or arrangement. Accordingly, one or more blades 280, or other tail sealer system, can be configured to apply the bonding material in the desired pattern.

After application of the bonding material, the wound log 120 rolls down the table 240 to the out-feed rolls 294 which compress the tail 220 to the body 130. In embodiments utilizing a nonadhesive PCM, the nonadhesive PCM, while in its amorphous state, wicks through the fibers of each of the tail 220 and the body 130 to form mechanical bonds. In some embodiments, subsequent to applying the heated nonadhesive PCM material to the application site, heat can be removed from the applied nonadhesive PCM to expedite the phase change from an amorphous state to a non-amorphous (e.g., a solid state) to expedite the bonding process. In other embodiments, ambient temperature is sufficient to change the phase of the nonadhesive PCM material at a suitable rate. In embodiments utilizing an adhesive-based bonding material, such as a glue, solvent evaporation of the bonding material can be utilized to create the bond.

The lower out-feed roll 296 runs slower than the upper out-feed roll 298, which moves the wound log 120 through the out-feed rolls 294 for a controlled duration, similar to the in-feed rolls 210. The lower out-feed roll 296 speed is controlled as a percentage of the upper out-feed roll 298 speed. More closely matching the upper out-feed roll 298 and lower out-feed roll 296 speeds will allow the out-feed rolls 294 to hold the wound log 120 longer.

When the wound log 120 is released from the out-feed rolls 294, it rolls down the table 240 to the next converting operation—typically an accumulator in-feed. A typical blade-in-pan style tail sealer 100 may operate at a rate of not less than about 20 logs processed/minute, or at rate of about 30 to about 60 logs processed/minute, or a rate of about 50 to about 60 logs processed/minute.

As one of skill in the art will recognize, other arrangements of portions of the exemplary tail sealers 100 can be used. For instance, the relative speeds of the upper in-feed rolls 212 and lower in-feed rolls 214 may be changed, the table 240 placement as well as the presence of a log in-feed section, log index to sealing station, tail identifying, tail winding and log discharge portions may be modified. As a nonlimiting example, belts may be used in lieu of rolls. Likewise, the angles and distances of the blade 280 and/or the he pan 292 relative to the application site and/or table 240 may be altered as may the application pressure or velocity. Additionally, timers and/or other control features may be used to manage the rate of operation and/or prevent backlog or overfeeding of the logs 120 into the tail sealer 100.

Furthermore, while FIG. 1 depicts the use of a pan and blade arrangement for applying the bonding material to the wound log 120, any other application technique may be used. For example, in one embodiment, a nonadhesive PCM in an amorphous state, a glue, or other type of bonding material may be extruded through apertures in an applicator. The applicator may be configured to apply the bonding material in any number of non-uniform patterns, as described in more detail below, and may be configured to apply the bonding material to the tail 220, the body 130, or both. Additional details regarding an example applicator suitable for extruding a bonding material may be found in U.S. Pat. Nos. 8,002,927 and 7,905,194, which are incorporated herein by reference. In other embodiments, additionally or alternatively, a spray nozzle, a single or multi bead coater, a spiral spray coater, a print applicator or the like equipment suitable for applying bonding material to one or more portions of the wound log 120 may be utilized by the tail sealer 100 without departing from the scope of the present disclosure.

Figure 2:
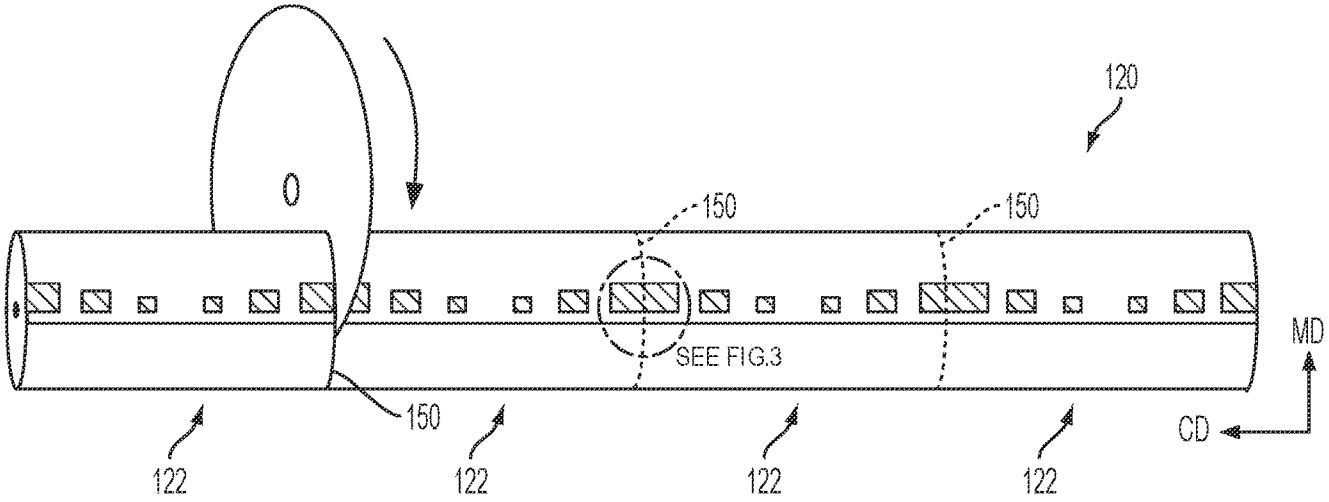
FIG. 2 schematically depicts a wound log being cut into a plurality of consumer-sized wound rolls.
Figure 4:
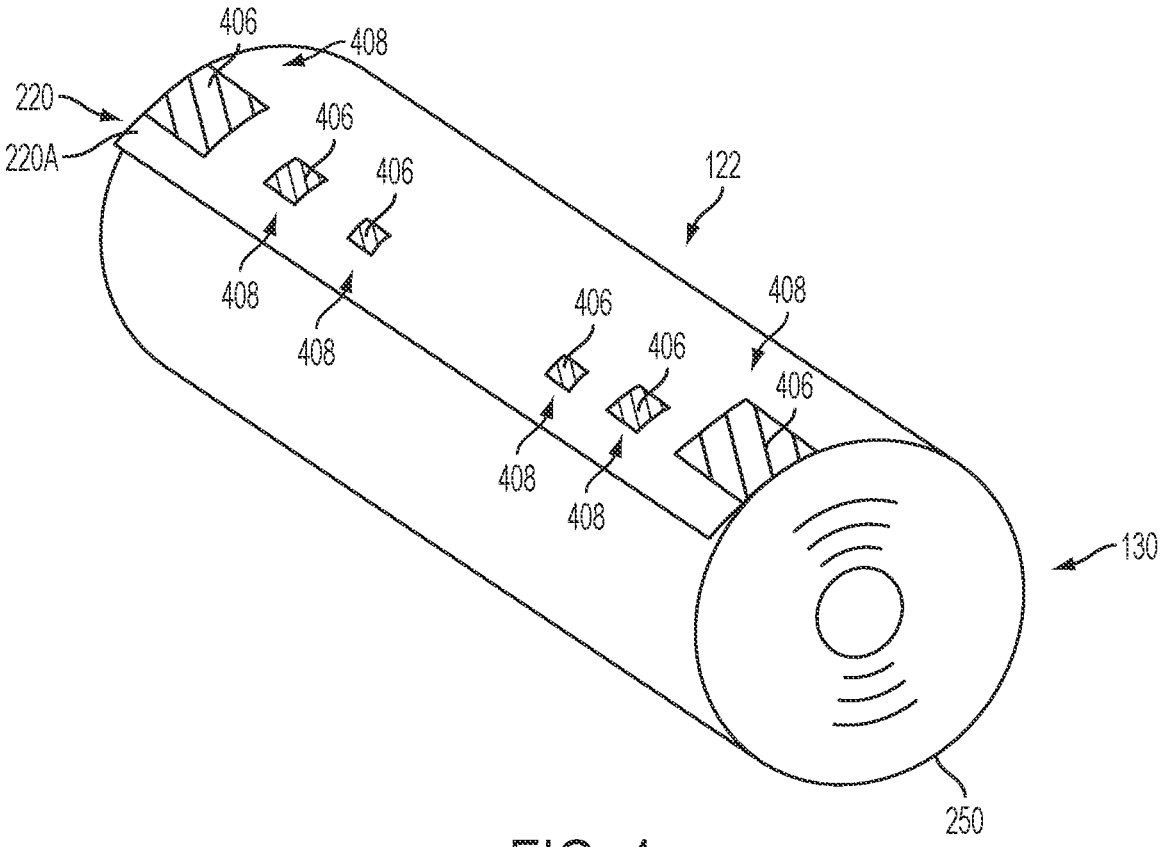
FIG. 4 depicts a perspective view of an example wound roll having a non-uniform tail sealing pattern subsequent to being cut from the wound log of FIG. 1.

During the manufacturing process, the wound log 120 depicted in FIG. 1 can be cut into two or more consumer-sized rolls. FIG. 2 schematically depicts a wound log 120 being cut into a plurality of consumer-sized wound rolls 122 and FIG. 4 depicts a perspective view of an example wound roll 122 having a non-uniform tail sealing pattern. Referring to FIG. 4, the tail 220 and the body 130 are bonded with a bonding material 406 applied at each application site 408. It is noted that the relative size, shape and position of the bonding material 406 and the application sites 408 in FIG. 4 are merely for the purposes of illustration and not intending to be limiting. Further, while the process described in FIG. 1 applies the bonding material 406 to the body 130 prior to the tail 220 being compressed to the body 130, in other embodiments the bonding material 406 can be applied to the outward facing surface 220A of the tail 220, such that it wicks through the tail 220 and into the body 130. In other embodiments, the bonding material 406 can be applied to an inward facing surface (not shown) of the tail 220 prior to the tail 220 being attached to the body 130. In any event, the bonding material 406 may be emitted, extruded, printed, or otherwise applied, to the wound log 120 in a non-uniform pattern.

The non-uniform pattern may include for example, a higher concentration of bonding material positioned towards the outer edges of the body 130. The non-uniform pattern may include a plurality of discrete, disconnected application sites 408, as shown in FIGS. 2 and 4. In some embodiments, the non-uniform pattern is a wavy, curved, or curvilinear pattern such that there is generally a contiguous application site 408 in the cross direction, for example. Nevertheless, the overall pattern or arrangement of the application site 408 is non-uniform in either the CD, the MD, or both. Example non-uniform patterns are described in more detail below. The non-uniform pattern may be generally optimized to utilize sufficient bonding material to maintain attachment of the tail 220 to the body 130 during manufacturing, while also providing a consumer with ease of detachment. In this regard, a greater amount of bonding material or application sites may be located towards the outsides edges of the tail 220, which are more likely to become unattached during manufacturing, as compared to the center region of the tail 220.

Further, the bonding material 406 can be generally clear or transparent, or can be opaque or comprise a color or tint. It may be desirable, for example, to apply a tinted or colored bonding material 406 at certain application sites 408 and apply clear or transparent bonding material 406 at other application sites 408. The tinted or colored bonding material 406 may aid in instructing the consumer how to efficiently separate the tail 220 from the body 130. For example, the tinted or colored bonding material 406 may be applied such that it highlights or directs a consumer to a grasping portion of the tail 220. A grasping portion of the tail 220 may be a portion of the tail 220 that is devoid of bonding material 406, or otherwise includes a relatively lesser amount of bonding material 406 or bond strength to facilitate ease in separation of the tail 220 from the body 130 by a consumer. In some embodiments utilizing a nonadhesive PCM, the bonding material may be a first color when in an amorphous phase and a second color when in a non-amorphous phase. In some embodiments, the nonadhesive PCM is a wax, such as a petroleum wax or a synthetic wax, for example. In some embodiments, a graphic, embossing, or other indicator, can be applied or located proximate to a particular portion of the tail 220 and/or the body 130 to visually provide guidance to a consumer. For example, the indicator can be position proximate to a grasping portion of the tail 220.

Figure 3:
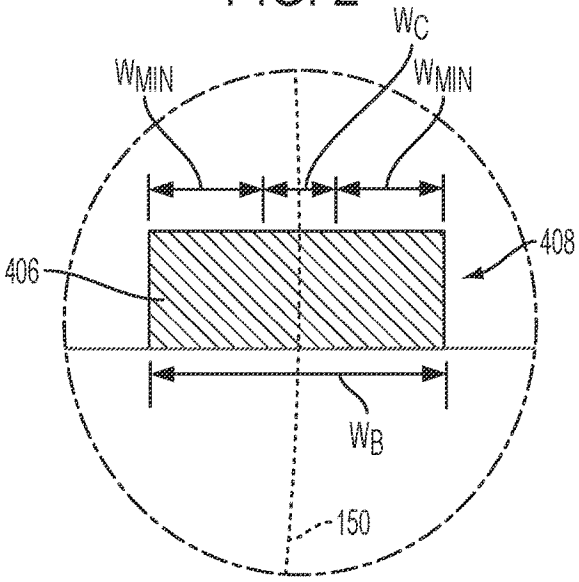
FIG. 3 is an enlarged portion of FIG. 2 depicting an application site placement relative to a cut line.

FIG. 3 is an enlarged view of a portion of FIG. 2 showing a portion of the wound log 120 that is cut during the manufacturing process. An application site 208 can be positioned along the wound log 120 such that the application site 208 is split when the wound log 120 is separated into wound rolls 122. Dashed cut line 150 indicates where the cutting member will cut the wound log 120. Due to various factors during the manufacturing process, the actual cut lines for any particular wound log 120 may vary in the CD. This amount of variance, sometimes referred to as a cutting zone, is schematically illustrated in FIG. 3 by the width "$W_C$." In some cases, $W_C$ may be 0.5 inches or more. It is desirable, however, that irrespective of where the cut is actually made within the width $W_C$, a minimum amount of bonding material 406 will be on either side of the cut line 150 to maintain proper bonding of the tail 220 (FIG. 4) to the body 130 (FIG. 4). In the illustrated embodiment, the width of the minimum amount of bonding 406 is illustrated as $W_{min}$. In order to account for the variance of the cut line 150 in the CD, and the desire to have sufficient bonding material on adjacent wound rolls 122 subsequent to being cut, application sites 408 that span a cut line 150 can have a width in the CD that is equal or greater to $W_{min}+W_C+W_{min}$.

Figure 5:
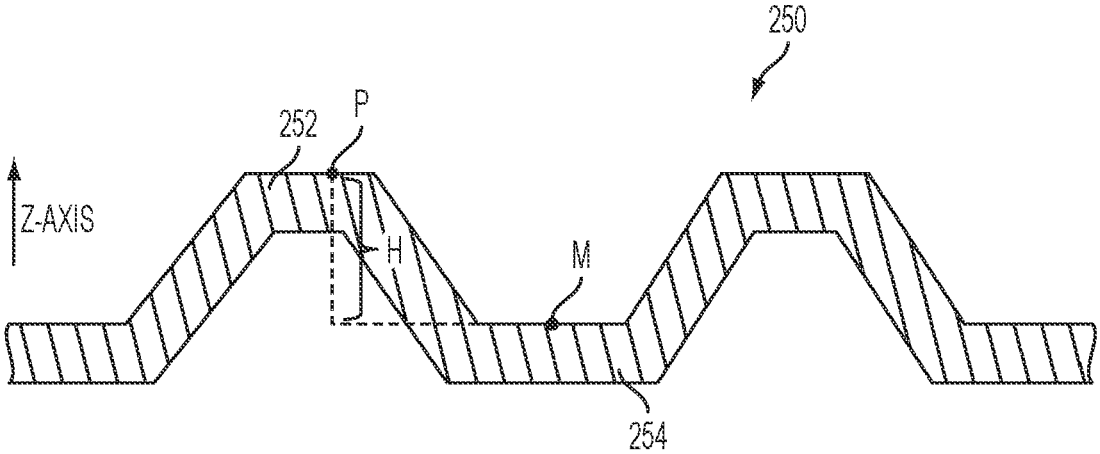
FIG. 5 is a schematic representation of a cross-sectional view of an exemplary material according to one embodiment of the present disclosure.

The wound roll 122 may comprise a web material 250 that is a fibrous structure. The web material 250 may be provided as a single-ply or multi-ply sanitary tissue product, such as a paper towel product or a bath tissue product, for example. As shown in FIG. 5, which is a cross-sectional view of an example web material 250 shown in FIG. 4, the web material 250 may have a peak 252 and a valley 254, which can be formed by embossing or textural elements. The peak 252 and/or valley 254 may be formed at various stages during the process of making the web material 250. In one nonlimiting example, creping may cause such peaks 252 and/or valleys 254 in a fibrous structure. Likewise, the peaks 252 and/or valleys 254 may be wet-formed, (occurring while the fibers of a fibrous structure are wet) by, for example, a belt having particular shapes or holes. In another nonlimiting example, the peaks 252 and/or valleys 254 of a fibrous structure may be dry-formed (i.e., formed after the fibrous structure is dry) which typically occurs during converting processes such as embossing. In another nonlimiting example, the peaks 252 are formed as a by-product of the formation of valleys 254 in the web material 250. Similarly, the valleys 254 may be formed as a by-product of the formation of peaks 252 in the web material 250.

Generally, the peaks 252 and valleys 254 extend in opposite directions in Z-direction. In one nonlimiting example, a peak 252 extends upward in the Z-direction. The valley 254 in this case may extend downward in the Z-direction, away from the peak 252. In one embodiment, the peak 252 is located on the tail 220. In another embodiment, the peak 252 is located on the body 130 (i.e., the non-tail portion). Alternatively, the peaks 252 may be found on both the body 130 and the tail 220. Likewise, valleys 254 may be located on the tail 220, the body 130 or both the portions of the web material 250. The peaks 252 and/or valleys 254 may be found on one or multiple sides of the web material 250. Where multiple peaks 252 are found on the web material 250, said peaks 252 may comprise different heights, shapes and/or sizes. Likewise, where multiple valleys 254 are found on a web material 250, the valleys 254 may comprise different heights, shapes and/or sizes.

In one nonlimiting example, a peak 252 and valley 254 are adjacent and have a maximum height distance, H, of about 180 microns to about 1750 microns between them. In another nonlimiting example, the maximum height distance, H, is from about 365 microns to about 780 microns. The height distance is measured by measuring the corresponding features of the embossing roll (i.e., a ridge, tooth, etc.), or other apparatus, used to apply or otherwise produce the peak 252 and the valley 254 in the web material 250.

In one nonlimiting example, as shown in FIG. 3, the peak 252 has a maximum height, P, as measured in the Z-direction when the web material 250 having the peak 252 is laid against a flat surface. In such instance, P is measured from the point furthest away from the flat surface in the Z-direction. An adjacent valley 254 may have a minimum height, M, which may be the furthest point from P in the Z-direction within the valley 254. The maximum height distance, H, would be the distance from P to M, along the Z-axis. In one embodiment, the bonding material 406 (FIG. 2) is uniformly distributed, such that a sufficient number of bonding sites exist on the peak 252 to ensure maximum bonding of the tail 220 to the body 130 within about 1 minute to about 10 minutes, or within about 1 minute to about 5 minutes, or within about 1 minute to about 2 minutes after application.

In accordance with some embodiments utilizing nonadhesive PCM as the bonding material 406, the bond strength between the tail 220 and the body 130 can be selectively reduced subsequent to forming the bond between the tail 220 and the body 130. For example, once the wound log 120 is cut into consumer sized widths and packaged, or at least ready for packaging, the nonadhesive PCM may be in a generally solid state and mechanically entangled with the both the tail 220 and the body 130. It may not be necessary, however, to maintain a relatively high bond strength at this point in the manufacturing process. A strength degradation accelerator may be used to change the phase of the nonadhesive PCM to the amorphous state. In one embodiment, heat is used as the strength degradation accelerator and the wound log 120 is passed through a heat tunnel or other type of oven. The particular amount of heat necessary to initiate the phase change may be based on, for example, the amount of nonadhesive PCM present on the wound log 120. Additionally or alternatively, other strength degradation accelerators may be used, such as pressure changes, vibrations, and/or combinations thereof, for example. In one embodiment, the wound log 120 is individually heated. In other embodiments, heat is applied to a package of a plurality of consumer-sized widths of the wound log 120 that have been prepared for shipping or distribution. In any event, once in the amorphous state, the nonadhesive PCM may wick through the webs of the tail 220 and the body 130, thereby reducing the relative bond strength. The nonadhesive PCM can then be transitioned back to the solid state through a removal of heat, either by removing the heat source or using other cooling techniques. In view of this reduction of the bond strength, a consumer interacting with the product may be able to separate the tail from the body with relative ease due to the diminished bond strength.

FIGS. 6-15 depict example non-uniform tail sealing patterns in accordance with various non-limiting examples. As is to be appreciated, a wide variety of other non-uniform tail sealing patterns can be utilized without departing from the scope of this disclosure. Further, while the non-uniform tail sealing patterns are schematically depicted as being presented to the outer surface 220A of the tail 220, any suitable technique can be used to apply the bonding material that will arrive at the illustrated non-uniform tail sealing pattern. By way of example, bonding material can be applied to an inner surface of the tail 220 when the tail 220 is unrolled from the body 130, as described above with regard to FIG. 1. In another example, the tail portion 130 can be in an unrolled configuration and the bonding material can be applied to the portion of the body 130 that will be covered by the tail 220 once the tail 220 is rolled around the body 130. In yet another example, some of the bonding material can be applied to a first portion (i.e. on the tail 220) and some of the bonding material can be applied to a second portion (i.e., on the body 130), such that when the tail portion 220 is rolled around the body 130, a composite non-uniform tail seal pattern is formed.

Figure 6:
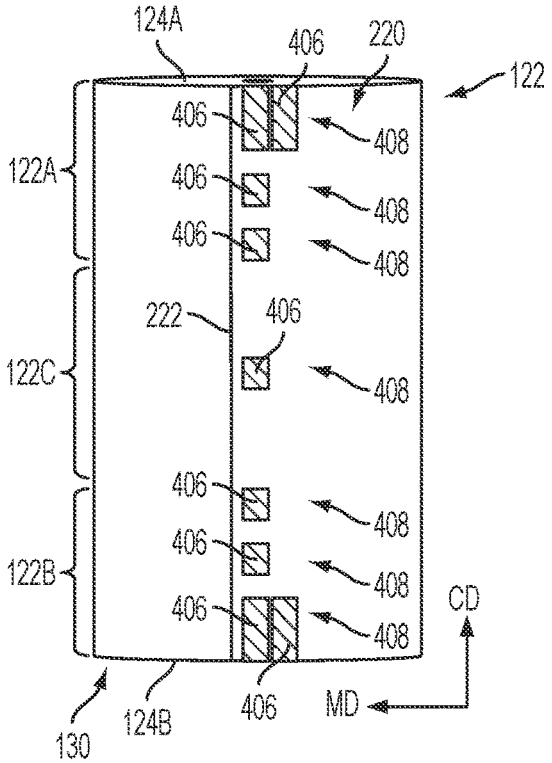
FIGS. 6-15 are schematic non-limiting representations of various wound rolls having non-uniform tail sealing patterns.

Referring now to FIG. 6, an example non-uniform tail sealing pattern is depicted. The wound roll 122 has a first outer edge 124A and a second outer edge 124B. The wound roll 122 has a first outer portion 122A bounded in the CD by the first outer edge 124A and a second outer portion 122B bounded by the second outer edge 124B. The wound roll 122 has a central portion 122C positioned along the CD between the first outer portion 122A and the second outer portion 122B. The tail 220 has end edge 222 that extends in the CD between the first outer edge 124A and the second outer edge 124B. It is the end edge 222 that is generally manipulated by a user attempting to separate the tail 220 from the body 130 during an initial interaction with wound roll 122.

In the illustrated embodiment, a higher concentration of application sites 408 are positioned in the first outer portion 122A and the second outer portion 122B as compared to the number and/or size of application sites 408 positioned in the central portion 122C. Utilizing more bonding material towards the first outer edge 124A and a second outer edge 124B can mitigate undesired unrolling of the wound roll 122 during the manufacturing process. The application sites 408 immediately proximate to the first outer edge 124 and the second outer edge 124B may also extend further in the MD than other application sites 408, such as the application sites 408 in the central portion 122C. In some embodiments, the non-uniform tail sealing pattern depicted in FIG. 6 can be provided using a blade-in-pan tail sealer having a plurality of blades. Each blade within the pan can be individually configured, such as through a notched arrangement, to deliver the bonding material 406 in a particular pattern.

Figure 7:
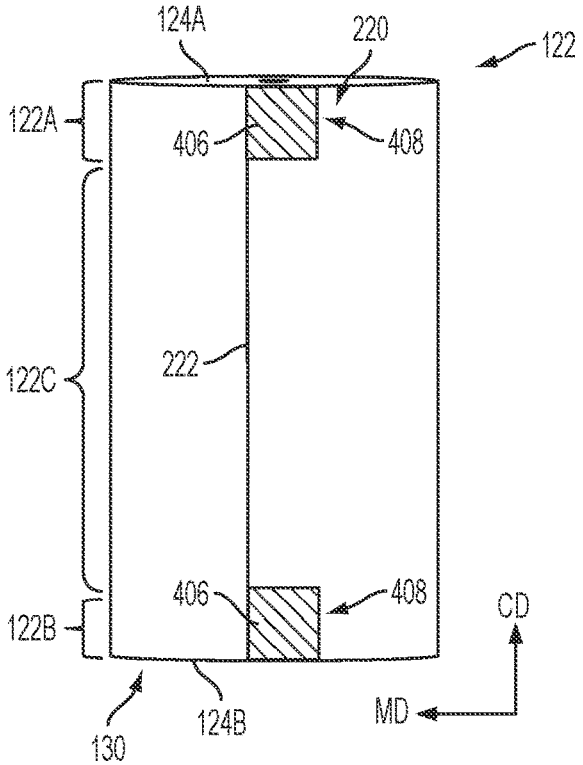
Figure 13:
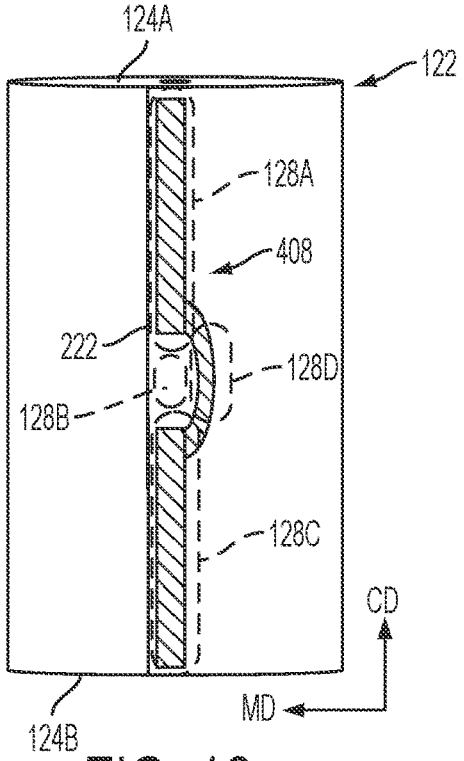

FIG. 7 depicts an example non-uniform tail sealing pattern having application sites 408 positioned within both the first outer portion 122A and the second outer portion 122B. In this embodiment, the central portion 122C is devoid of any application sites. The application sites 408 can be bounded by the end edge 222 in the MD, as shown in FIG. 7, or there may be a gap in the machine direction between the application site 408 and end edge 222, as shown in FIG. 6, to form a tab. Further, the application sites 408 can be bounded by one of first outer edge 124A or the second outer edge 124B in the CD, as shown in FIG. 7, as may be formed if an application site spans a cut line. Alternatively, there may be a gap between the application sites 408 and the first outer edge 124A or the second outer edge 124B in the CD, as shown in FIGS. 10 and 13, described in more detail below.

Figure 8:
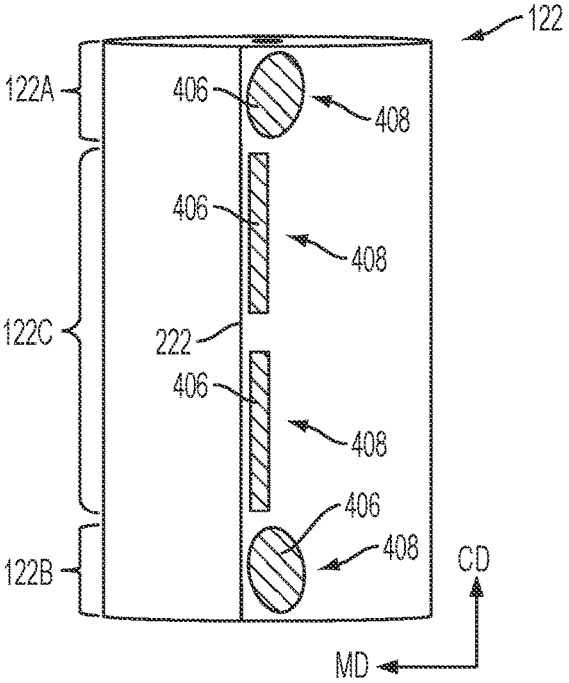

FIG. 8 depicts an example non-uniform tail sealing pattern having a plurality of application sites 408 that differ in shape and size. In the depicted embodiment, the application sites 408 positioned within the first outer portion 122A and the second outer portion 122B are generally rounded whereas the application sites 408 positioned within the central portion 122C are generally rectangular. As is to be appreciated, other shapes and arrangements can be utilized without departing from the scope of the present disclosure.

Figure 9:
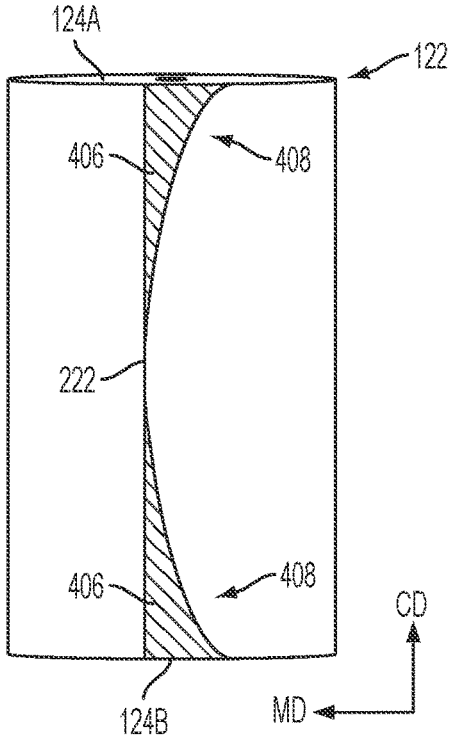

FIG. 9 depicts an example non-uniform tail sealing pattern having a plurality of application sites 408 that are flared in the MD. As shown, the application sites 408 are flared such that there is a higher amount of bonding material 406 positioned proximate the first outer edge 124A and a second outer edge 124B. The amount of bonding material 406 applied to a central portion of the end edge 222 can be relatively less than the amount of bonding material 406 applied proximate to each the first outer edge 124A and a second outer edge 124B.

Figure 10:
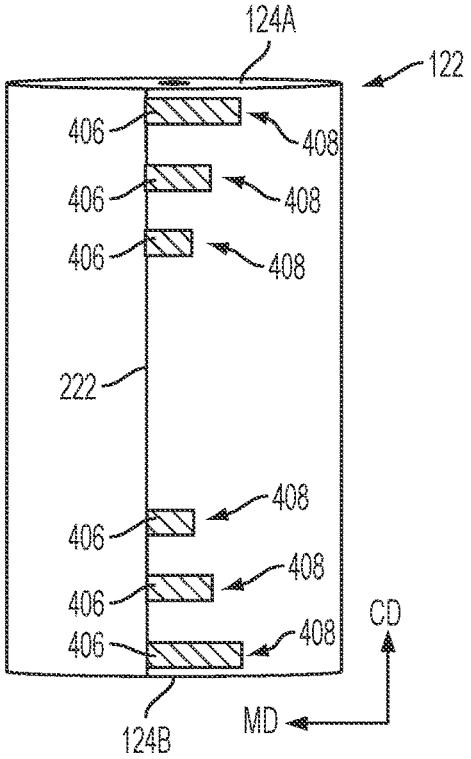

FIG. 10 depicts an example non-uniform tail sealing pattern having a plurality of application sites 408 having MD lengths that vary. In particular, the application sites 408 proximate to the first outer edge 124A and the second outer edge 124B extend in the MD further than the other application sites. Further, while the application sites 408 are generally shown being evenly spaced in the CD, this disclosure is not so limited. In some embodiments, the application sites 408 may have generally the same length in the MD, but be positioned in the CD such that there is a higher concentration of boning material 406 proximate to the first outer edge 124A and a second outer edge 124B compared to other portions of the wound roll 122.

Figure 11:
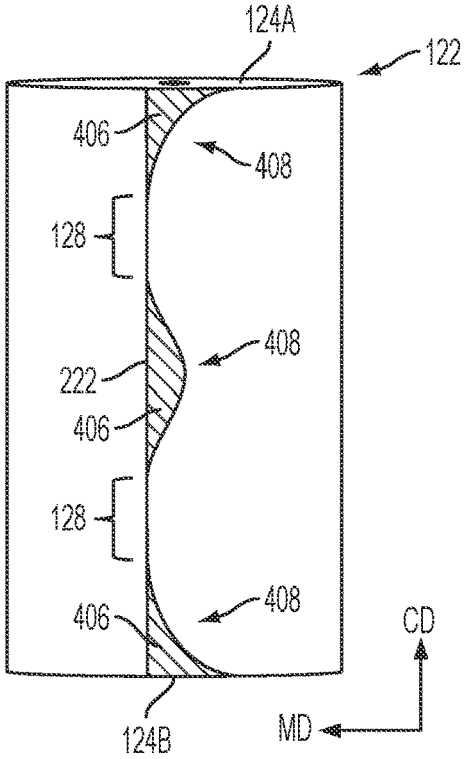

FIG. 11 depicts another example non-uniform tail sealing pattern having a plurality of application sites 408 that curved and flared in the MD. In this embodiment, the application sites 408 are positioned proximate the first outer edge 124A and the second outer edge 124B. An additional application site 408 is positioned proximate to a center of the end edge 222. Grasping portions 128 are found between the application sites 408. The grasping portions 128 provide regions along the end edge 222 that is substantially devoid of any application sites. The grasping portions 128 may be sized in the CD such that a consumer can insert their fingers between the tail 220 and the body 130 to break the seal created by the bonding material 406 at the application sites 408.

Figure 12:
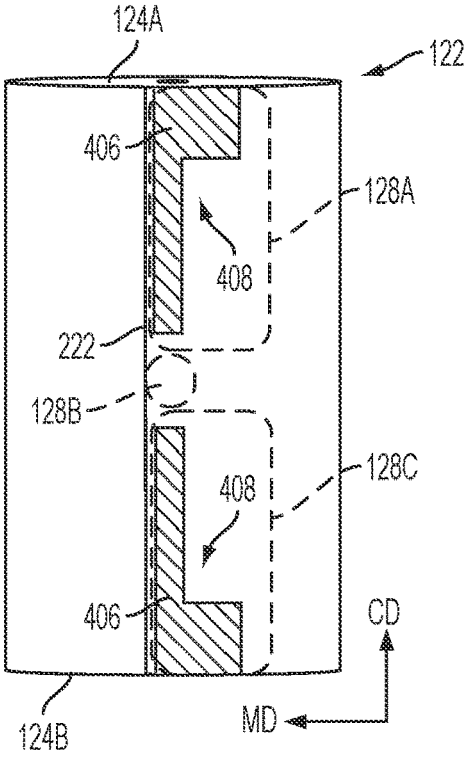

FIG. 12 depicts an example non-uniform tail sealing pattern that generally defines a first portion 128A, a second portion 128B, and a third portion 128C. In the illustrated embodiment, the first and third portions 128A, 128C each have application sites 408. The second portion 128B, however, is devoid of application sites 408 and can therefor serve as a grasping portion. While the second portion 128B is schematically depicted as being generally centered in the CD along the end edge 222, other configurations can be used without departing from the scope of this disclosure. For example, the portion that is devoid of any application sites may be positioned closer to the first outer edge 124A than the second outer edge 124B.

FIG. 13 depicts an example non-uniform tail sealing pattern that generally defines a first portion 128A, a second portion 128B, and a third portion 128C, similar to FIG. 10, but also defines a fourth portion 128D. The second portion 128B is positioned in the MD such that it is between the end edge 222 and the fourth portion 128D. The fourth portion 128D can have one or more application sites 408. In the illustrated embodiment, the application site 408 can be continuous in the MD, while spanning each of the first portion 128A, the second portion 128B, and the third portion 128C. In this arrangement, a grasping portion can be provided to the consumer, while still maintaining a tail seal that spans the wound roll 122 in the CD.

Figure 14:
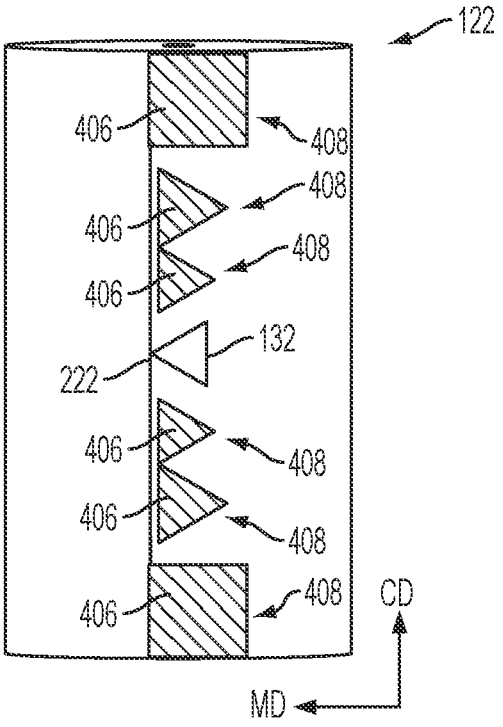
Figure 15:
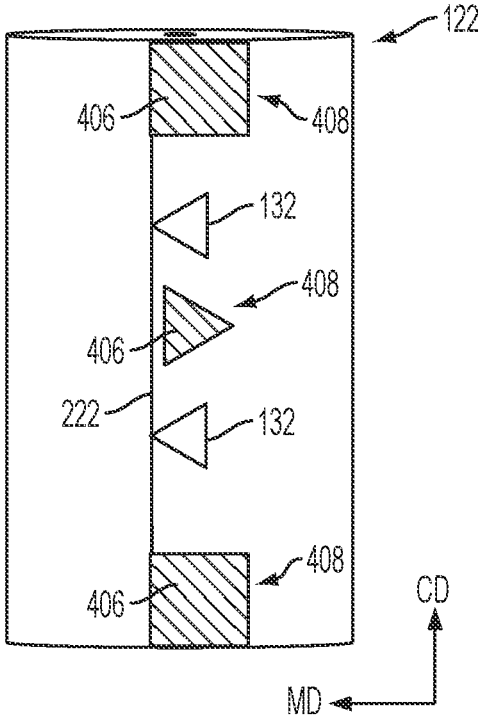

FIG. 14 depicts a wound roll 122 having an example non-uniform tail sealing pattern and schematic representation of a visual indicator 132 positioned proximate to the end edge 222. The visual indicator 132 can provide an indication to the consumer, such as an indication of a grasping portion or an indication of a portion of the tail 130 having a relatively weak bond strength. The visual indicator 132 can be positioned between application sites 408, as shown in FIG. 12, or the visual indicator 132 can overlay a portion of, or substantially all of, an application site. In some embodiments, an application site serves as the visual indicator 132. For example, a colored or tinted bonding material 406 can be used. In some embodiments, the visual indicator 132 is a texture or a three-dimensional feature, such as an embossed feature. In some embodiments, the visual indicator 132 is a print graphic. The visual indicator 132 can be, with limitation, a logo, a word, or a graphic. As shown in FIG. 15, for wound rolls 122 having a plurality of grasping portions or other portions configured to ease the unrolling process, a plurality of visual indicators 132 can be used along the end edge 222, each of which is generally aligned with one of those portions. Once cut into consumer-sized rolls, the wound roll 122 may have a tail seal release ranging from about 50 g/11 inch roll to about 400 g/11 inch roll, or from about 80 g/11 inch roll to about 300 g/11 inch roll, or from about 100 g/11 inch roll to about 200 g/11 inch roll as determined by the Tail Seal Release Strength Method described herein.

Tail Seal Release Strength Method

Tail seal release strength of typical paper towel or tissue sample sealed in accordance with the apparatus and method described above can be evaluated using this method. Time of evaluation should be chosen to correlate with desired intervals of importance in the product's life-cycle (i.e. during processing, at consumer use, etc.)

A) Start timing from application to the wound log.

B) Collect the roll once it is in consumer-sized finished roll format.

Figure 16:
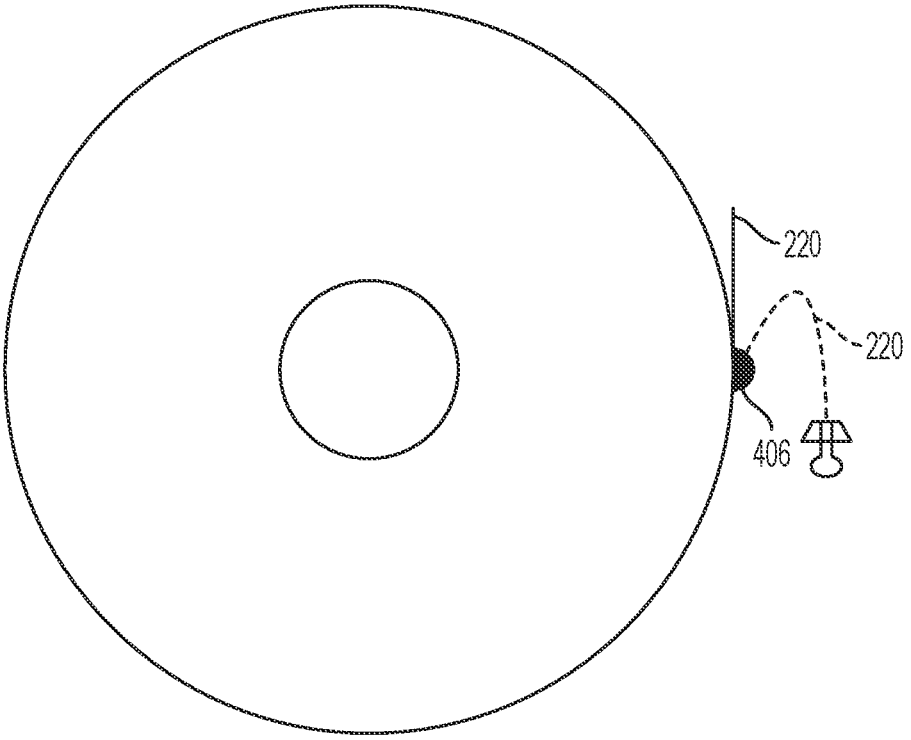
FIG. 16 is a cross-sectional view of a consumer-sized convolutely wound roll of web material according to one embodiment of the present disclosure.

C) Once desired time interval has elapsed after application, begin testing. Hold roll in a horizontal position with the tail disposed at the 3 o'clock position, where the tail is pointed upwards as shown in FIG. 16.

D) While holding roll in position attach weighted clips having known weights to the center of the tail. Successive clips are attached to alternating sides of the preceding clip.

Alternatively, a single weighted clip having a known weight can be used in combination with a set of known weights which can be added to the single clip either singly or in combination. (See FIG. 16 generally showing the movement of the tail once a clip is attached.)

E) Once the tail fully releases from the roll, stop and remove clips and/or weights.

F) Sum up the masses of all the clips/weights that were attached to the roll at tail release. This total weight is the tail-release strength.

G) Enter the total weight in the summary sheet.

Figure 17:
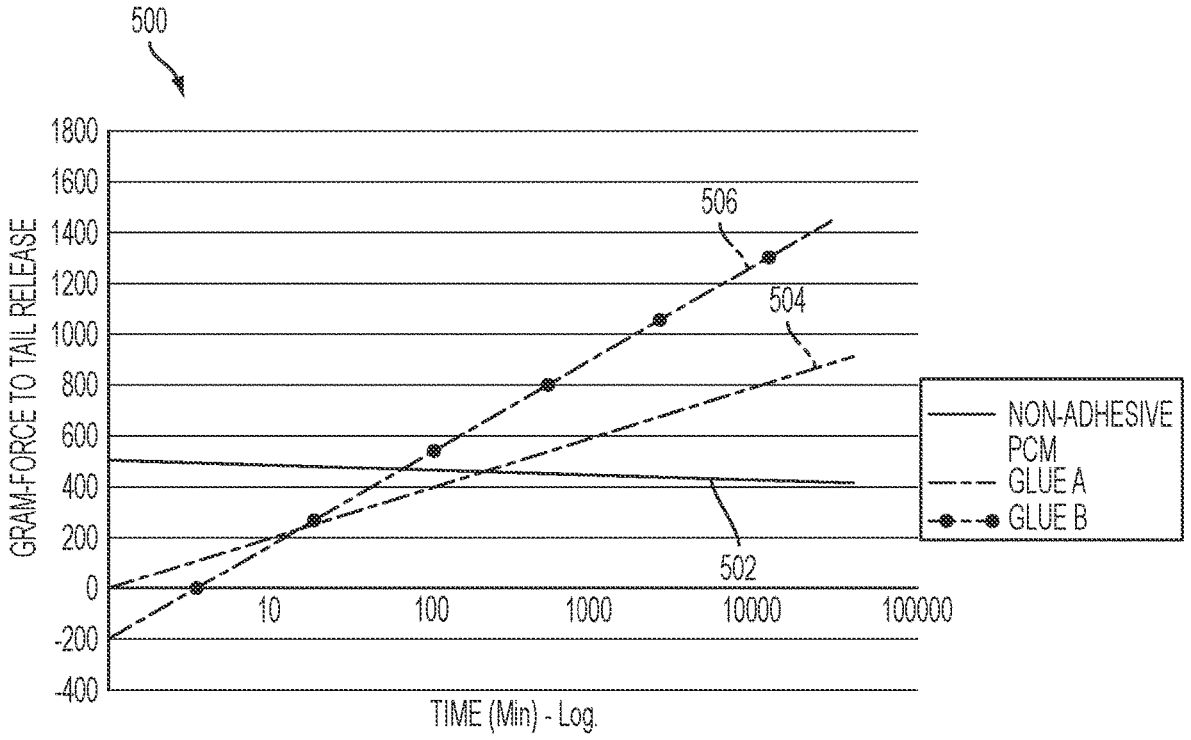
FIG. 17 shows a graph depicting tail release strength over time for consumer product units bonded with an example nonadhesive phase-change material (PCM) and two different adhesive-based materials.

FIG. 17 shows a graph 500 depicting tail release strength over time for example consumer product units bonded with an example nonadhesive PCM and two different adhesive-based materials (shown generically as Glue A and Glue B), as determined by the Tail Seal Release Strength Method outlined herein. The vertical axis represents gram-force to tail release (gf) and the logarithmic horizontal axis represents time (minutes). Bonding a tail portion to the body is generally a process aid to facilitate efficient downstream processing of the log. Once the downstream processing, sometimes called converting, is completed, the desirability to have a strong bond strength decreases dramatically. For example, once the log has been cut into consumer sized widths and packaged, there is little to no need to have the tail bonded to the body with a high tail release strength. The tail release strength of the nonadhesive PCM, shown as curve 502, demonstrates a high initial tail release strength that declines slightly over time. This bond strength behavior is advantageous as bond strength is provided for downstream processing, yet diminishes by the time a consumer would interact with the product. By comparison, curves 504, 506 demonstrate a lower initial tail release strength that continues to increase over time. As shown by graph 500, when a glue is used to form the bond, that bond strength will continue to increase over time, as the water content of the glue continues to evaporate. Once the product reaches the consumer, the bond strength may be at a maximum amount, which may lead to product waste and consumer frustration or dissatisfaction, as described herein. Furthermore, as shown by curves 504, 606, during the time period immediately after application, the relative tail release strength for the glue is low as the water content in the glue has not yet evaporated. This is the time period, however, that it may be desirable to have relatively strong bond strength so that the log can withstand the downstream processing. By comparison, the curve 502 illustrates that the bond strength form by the nonadhesive PCM desirably behaves as a processing aid while not detrimentally impacting the end consumer. The tail release strength is initially high, which aids in the processing that occurs subsequent to the tail sealing process and then declines over time such that when the product reaches the consumer, the consumer can separate the tail from the body with relatively less effort.

Figure 18:
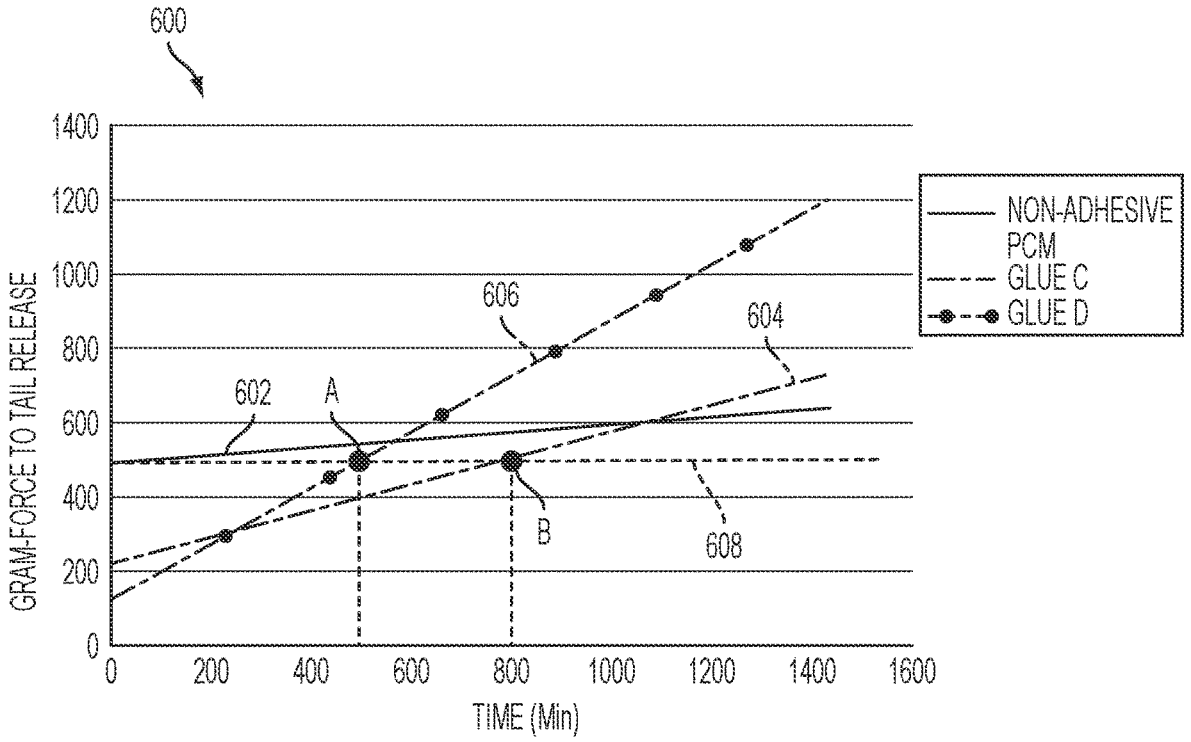
FIG. 18 shows a graph depicting tail release strength over time for consumer product units bonded with an example nonadhesive PCM and two different adhesive-based materials.

FIG. 18 shows another example graph 600 depicting tail release strength over time for consumer product units bonded with another example nonadhesive PCM and two different adhesive-based materials (shown generically as Glue C and Glue D), as determined by the Tail Seal Release Strength Method. The vertical axis represents gram-force to tail release (gf) and the horizontal axis represents time (minutes). The tail release strength of the nonadhesive PCM, shown as curve 602, demonstrates a high initial tail release strength that does not aggressively increase over the first 1400 minutes subsequent to application. By comparison, curves 604, 606 demonstrate a lower initial tail release strength that continues to increase over time.

Also shown in graph 600 is a horizontal line 608 that represents the initial tail release strength of the nonadhesive PCM. It is noted that the tail release strength of Glue C (curve 606) does not reach the same tail release strength as initial tail release strength of the nonadhesive PCM, shown as intersection A, until approximately 480 minutes (8 hours) after the glue is applied to the log. The tail release strength of Glue D (curve 604) takes approximately 800 minutes (13+ hours) to reach the same tail release strength as the initial tail release nonadhesive PCM, shown as intersection B.

As is to be appreciated, the tail release strength over time may differ based on the particular composition of the nonadhesive PCM that is used to bond the tail to the body. For example, some nonadhesive PCMs may offer higher or lower initial tail release strengths and then subsequently decline in strength and a greater or lesser rate that the curves 502, 602 depicted in FIGS. 17 and 18. For example, as described above, in some embodiments heat can be added or removed from the process in order to adjust the phase change of the nonadhesive PCM material. As such, the particular curves plotted in graphs 500, 600 are merely for the pedagogical purposes and not intended to be limiting.

Figure 19:
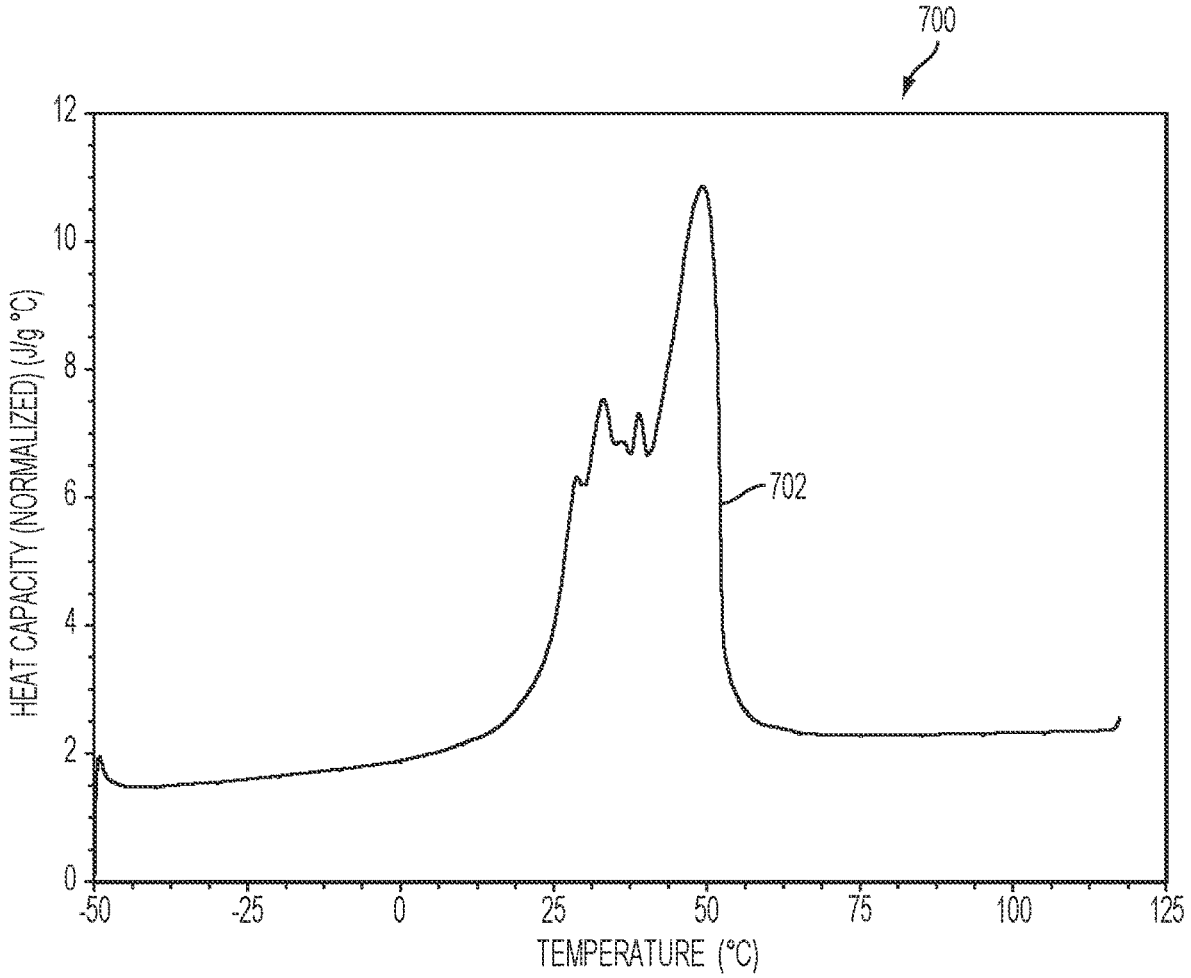
FIG. 19 shows a graph illustrating a differential scanning calorimetry (DSC) curve of an example nonadhesive PCM in accordance with the present disclosure.

FIG. 19 shows a graph 700 illustrating a differential scanning calorimetry (DSC) curve 702 of an example nonadhesive PCM in accordance with the present disclosure across a temperature range of −50° C. to 125° C. The vertical axis represents heat capacity (J/g·° C.) and the horizontal axis represents temperature (° C.). For the illustrated nonadhesive PCM, a glass transition temperature is around 15° C., with melting occurring from about 10° C. to about 65° C. As is to be appreciated by those skilled in the art, the peak heat capacity of the illustrated nonadhesive PCM represents when the phase changes. The peak heat capacity of the example nonadhesive PCM is about 11 J/g·° C. and occurs at a melting point around 50° C. According to some embodiments the heat capacity of the nonadhesive PCM is less than about 25 J/g·° C. In other embodiments, the heat capacity of the nonadhesive PCM is less than about 20 J/g·° C. In other embodiments, the heat capacity of the nonadhesive PCM is in the range of about 2 J/g·° C. to about 20 J/g·° C. In yet other embodiments, the heat capacity of the nonadhesive PCM is in the range of about 9 J/g·° C. to about 15 J/g·° C. In yet still other embodiments, the heat capacity of the nonadhesive PCM is in the range of about 6 J/g·° C. to about 12 J/g·° C. According to some embodiments the melting point of the nonadhesive PCM is in the range of about 10° C. to about 65° C. In other embodiments, the melting point of the nonadhesive PCM is in the range of about 30° C. to about 60° C. In yet other embodiments, the melting point of the nonadhesive PCM is in the range of about 45° C. to about 50° C.

Figure 20:
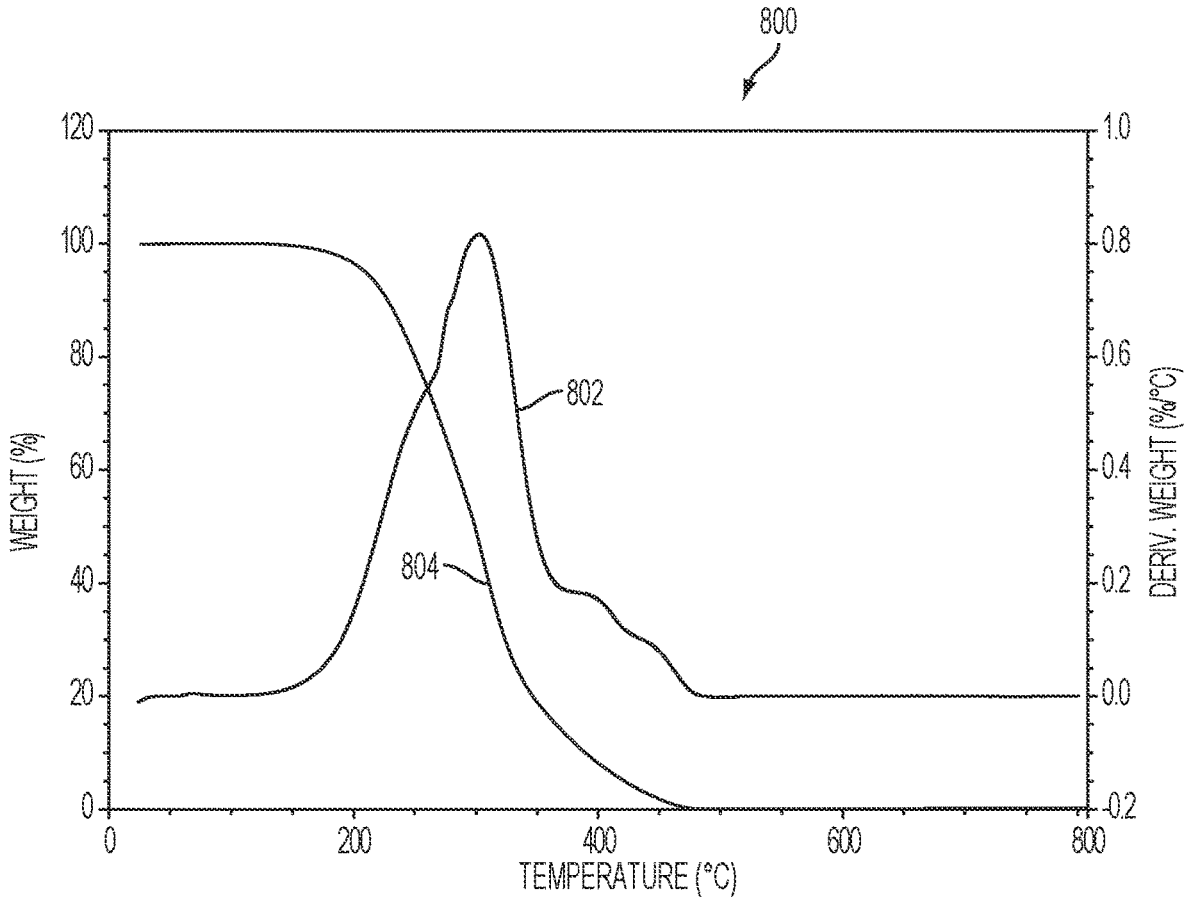
FIG. 20 shows a graph illustrating a DSC curve of an example nonadhesive PCM in accordance with the present disclosure.

FIG. 20 shows a graph 800 illustrating a DSC curves an example nonadhesive PCM in accordance with the present disclosure across a temperature range of 0° C. to 800° C. Specifically, the graph 800 shows the degradation of the nonadhesive PCM over the temperature range. The degradation is expressed in terms of curve 802 that represents the derived weight percent of the material (%/° C.). and curve 804 that represents the relative weight percent of the material (%) across the temperate range. For the illustrated nonadhesive PCM, degradation begins at around 142° C. (287.6° F.) and the maximum rate of degradation occurs around 375° C. (707° F.).

The differential scanning calorimetry data presented in FIGS. 19 and 20 may be according to the following Differential Scanning calorimetry Test Method. Utilizing a TA Instruments Discovery DSC, approximately 1.87 mg of the nonadhesive PCM is placed into a stainless steel high volume DSC pan. The sample, along with an empty reference pan (with a mass of 50.63 mg) is placed into the instrument. The samples are analyzed using the following conditions/temperature program: nitrogen purge; equilibrate at −50° C. until an isothermal is reach for 2.00 min; ramp the temperature at a rate of 20° C./min to 75.00° C. Each sample is analyzed in duplicate. The resulting DSC data is analyzed using TA Instruments Universal Analysis Software. The use of DSC is further described by T. de Vringer et al., Colloid and Polymer Science, vol. 265, 448-457 (1987); and H. M. Ribeiro et al., Intl. J. of Cosmetic Science, vol. 26, 47-59 (2004).

Figure 21:
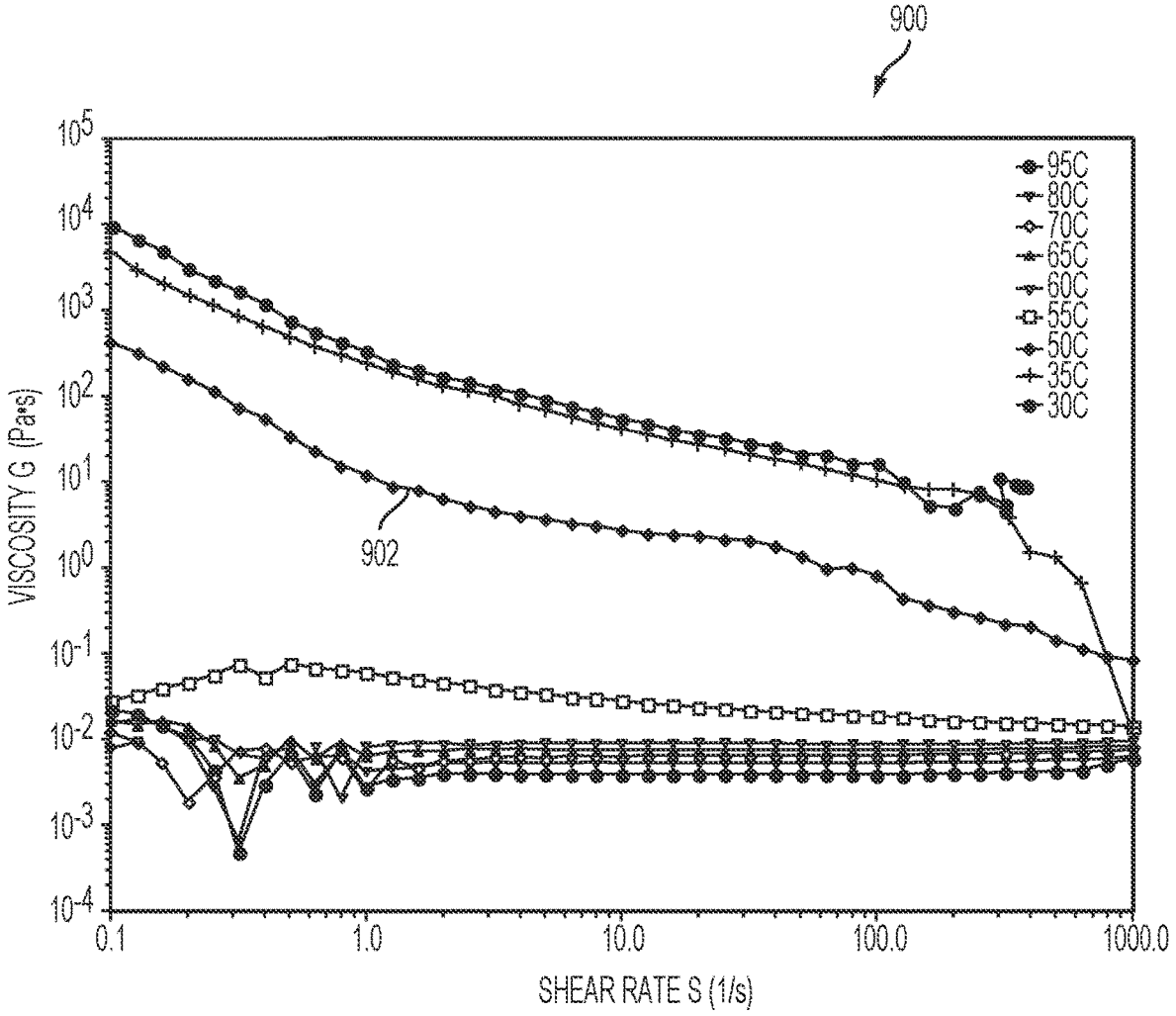
FIG. 21 shows a graph depicting viscosity data for an example nonadhesive PCM at varying temperatures.

FIG. 21 shows a graph 900 depicting viscosity data for an example nonadhesive PCM at varying temperatures range. The vertical axis represents viscosity (Pa·sec) and the horizontal axis represents shear rate (1/sec). At 70° C. (shown as curve 902), for example, the nonadhesive PCM behaves advantageously as it changes from an amorphous to a non-amorphous (i.e., solid) phase as it through the web, losing temperature as it travels. Furthermore, at this temperature, the nonadhesive PCM starts with a relatively high viscosity as compared to other temperatures presented on the graph 900. Furthermore, the nonadhesive PCM is more viscous that water (e.g., about five times more viscous) but much thinner than many other adhesive-based materials. Accordingly, during a tail sealing process, the nonadhesive PCM can be pushed onto and through a web with relatively less pressure as compared to adhesive-based materials.

The dimensions and/or values disclosed herein are not to be understood as being strictly limited to the exact numerical dimension and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for affixing a tail to a convolutely wound log of web material, the method comprising:

providing a log of wound web material, the web material having a machine direction and a cross direction, the log of wound web material having a tail portion comprising a tail end edge, the web material having a peak and a valley;

applying a bonding material to an exterior surface of the log of wound web material at a first application site and a second application site;

wherein the first application site is longer in the machine direction than the second application site;

wherein the first application site and the second application site are disconnected in the cross-direction;

wherein the first and second application sites have an MD extent greater than a CD extent;

wherein the first and second applications sites are different shapes; and wherein the first application site is closer to the tail end edge than the second application site.

2. The method of claim 1, wherein the bonding material is a nonadhesive phase-change material.

3. The method of claim 2, wherein applying the bonding material to the log of wound web material at each of the application sites comprises applying the nonadhesive phase-change material in an amorphous phase and wherein the nonadhesive phase-change material alters to a non-amorphous phase to create a bond.

4. The method of claim 3 wherein the bond has a tail release strength according to the Tail Release Strength Test Method and wherein the tail release strength of the bond at 5 minutes is greater than or equal to the tail release strength of the bond at 15 hours.

5. The method of claim 3 wherein the bond is created by altering the nonadhesive phase-change material by one of the group consisting of a temperature change, a pressure change, vibrations, and combinations thereof.

6. The method of claim 2 wherein the nonadhesive phase-change material degrades at between 100° Celsius (C) and 500° C. according to the Differential Scanning calorimetry Test Method.

7. The method of claim 2 wherein the nonadhesive phase-change material comprises a melting point between 10° C. and 65° C.

8. The method of claim 2 wherein the nonadhesive phase-change material comprises a heat capacity in the range of 2 J/g·° C. to 20 J/g·° C.

9. The method of claim 1 wherein the peak and the valley are disposed within plurality of application sites and wherein the maximum height distance between the peak and the valley is from 365 μm to 780 μm.

10. The method of claim 1, wherein the bonding material comprises an adhesive.

11. A method for affixing a tail to a convolutely wound log of web material, the method comprising:

providing a log of wound web material, the web material having a machine direction and a cross direction, the log of wound web material having a tail portion comprising a tail end edge, the web material having a peak and a valley;

applying a bonding material to an exterior surface of the log of wound web material at a first application site, a second application site, a third application site, and a fourth application site;

wherein the first and third application sites are longer in the machine direction than the second and fourth application sites;

wherein the first and third application sites are the same length in the machine direction;

wherein the first application site, the second application site, the third application site, and the fourth application site are disconnected in the cross-direction; and wherein at least the first and second application sites have an MD extent greater than a CD extent;

wherein the first and second applications sites are different shapes, and wherein the third and fourth applications sites are different shapes; and wherein the first application site is closer to the tail end edge than the second application site, and wherein the third application site is closer to the tail end edge than the fourth application site.

12. The method of claim 11, wherein the first and third application sites are the same distance from the tail end edge.

13. The method of claim 11, wherein the second and fourth application sites are the same distance from the tail end edge.

14. The method of claim 11, wherein the bonding material is a nonadhesive phase-change material.

15. The method of claim 14, wherein applying the bonding material to the log of wound web material at each of the first plurality of application sites and the second plurality of application sites comprises applying the nonadhesive phase-change material in an amorphous phase and wherein the nonadhesive phase-change material alters to a non-amorphous phase to create a bond between the tail portion and the body portion.

16. The method of claim 11, wherein the bonding material comprises an adhesive.

17. The method of claim 11 wherein the tail portion comprises a first side facing the body portion when the tail portion is associated with the body portion; and a second side opposite the first side; and wherein the first plurality of application sites and the second plurality of application sites are located on the second side of the tail portion.

18. The method of claim 11, wherein the visual indicator is a printed graphic.

19. The method of claim 11, wherein the first and third application sites are the same shape.

20. The method of claim 11, wherein the second and fourth application sites are the same shape.

* * * * *